US009786458B2

(12) United States Patent
Parker

(10) Patent No.: US 9,786,458 B2
(45) Date of Patent: Oct. 10, 2017

(54) PULSE SOLENOID CONTROL CIRCUIT

(71) Applicant: WCM Industries, Inc., Colorado Springs, CO (US)

(72) Inventor: Phil A. Parker, Naples, TX (US)

(73) Assignee: WCM Industries, Inc., Colorado Springs, CO (US)

( * ) Notice: Subject to any disclaimer, the term of this patent is extended or adjusted under 35 U.S.C. 154(b) by 233 days.

(21) Appl. No.: 14/644,364

(22) Filed: Mar. 11, 2015

(65) Prior Publication Data

US 2015/0262745 A1 Sep. 17, 2015

Related U.S. Application Data

(60) Provisional application No. 61/954,180, filed on Mar. 17, 2014.

(51) Int. Cl.
*H01H 47/22* (2006.01)
*H01F 7/18* (2006.01)

(52) U.S. Cl.
CPC ..... *H01H 47/226* (2013.01); *H01F 7/1872* (2013.01)

(58) Field of Classification Search
CPC ..... H01H 47/22; H01H 47/325; H01H 47/32; H01H 47/35
USPC ..... 361/160
See application file for complete search history.

(56) References Cited

U.S. PATENT DOCUMENTS

2012/0187967 A1* 7/2012 Chao ..... G11C 29/021 324/750.01

* cited by examiner

*Primary Examiner* — Dharti Patel

(57) ABSTRACT

Disclosed herein is a device comprising a pulse trigger switch module configured to generate a first control signal in response to a first input signal value and generate the second control signal in response to a second input signal value. An on pulse generator module provides a first pulse signal having a first predetermined pulse duration in response to the first control signal and an off pulse generator module provides a second pulse signal having a second predetermined pulse duration in response to the second control signal. An on pulse switch module connects a power signal to an output in response to the first pulse signal and an off pulse switch module connects the power signal to the output in response to the second pulse signal.

20 Claims, 3 Drawing Sheets

PULSE SOLENOID CONTROL CIRCUIT

This application claims the benefit of U.S. provisional application No. 61/954,180, filed on Mar. 17, 2014, titled "Pulse Solenoid Control Circuit," which is incorporated herein by reference.

TECHNICAL FIELD

The present disclosure relates generally to a system and method for controlling a latching solenoid, and, in particular embodiments, to a system and method for a solenoid control circuit that generates a pulsed control signal for a latching solenoid.

BACKGROUND

In the design of solenoids having latching coils there is a specified direct current (VDC) required to both latch ON and latch OFF the coil, thus either opening or closing the solenoid valve. We will assume that the coil is 12 VDC. Therefore, a 12 VDC current would be required to latch ON or open the solenoid valve. However, since the coil is of a latching nature, there is no need for continuous current to energize the coil. The basic principle of the latching coil is that a magnetic draw is present at both the open and closed positions of the coil. The VDC current applied to the coil increases the magnetic draw at the open end thus drawing the piston of the solenoid body towards the upper end of the coil or open position. By inverting this VDC current the magnetic draw is reversed, thus moving the piston of the relay to the lower or closed position. In both the on and off positions, the coil will maintain the piston's position without the need of continuous current.

A Programmable Logic Controller (PLC) or similar device cannot typically be programmed to transmit a brief voltage signal to the solenoid coil in order to latch on the solenoid valve and then transmit an inverted signal to latch off the valve. A continuous signal creates excess heat at the coil and unneeded energy expense.

BRIEF DESCRIPTION OF THE DRAWINGS

For a more complete understanding of the present embodiments, reference is now made to the following descriptions taken in conjunction with the accompanying drawings, in which.

Corresponding numerals and symbols in the different figures generally refer to corresponding parts unless otherwise indicated. The figures are drawn to illustrate the relevant aspects of the embodiments and are not necessarily drawn to scale. For clarity non-essential reference numbers are left out of individual figures where possible.

DETAILED DESCRIPTION OF ILLUSTRATIVE EMBODIMENTS

The making and using of the present embodiments are discussed in detail below. It should be appreciated, however, that the present disclosure provides many applicable concepts that can be embodied in a wide variety of specific contexts. The specific embodiments discussed are merely illustrative of specific ways to make and use the disclosed subject matter, and do not limit the scope of the different embodiments.

It has been discovered that a brief pulse signal is the best means of providing the needed current to latch ON and OFF for a solenoid valve. Presented herein is a circuit board that enables a continuous output signal to be converted into a brief direct current signal to permit a solenoid valve with a direct current latching coil to open and close as determined by the polarization of the direct current signal. The embodiments presented herein are directed to providing a circuit that generates a first pulse to turn on or activate a solenoid and a second pulse to turn off or deactivate the solenoid. In some embodiments, the circuit will provide no power between pulses, reducing the power required to control the solenoid. The pulses are generated in response to an input signal. The pulses are generated on the transition of the input signal, with the circuit generating a pulse when the input signal switches from an off state to an on state, and generating a pulse when the input signal switches from the on state to the off state.

Figure 1:
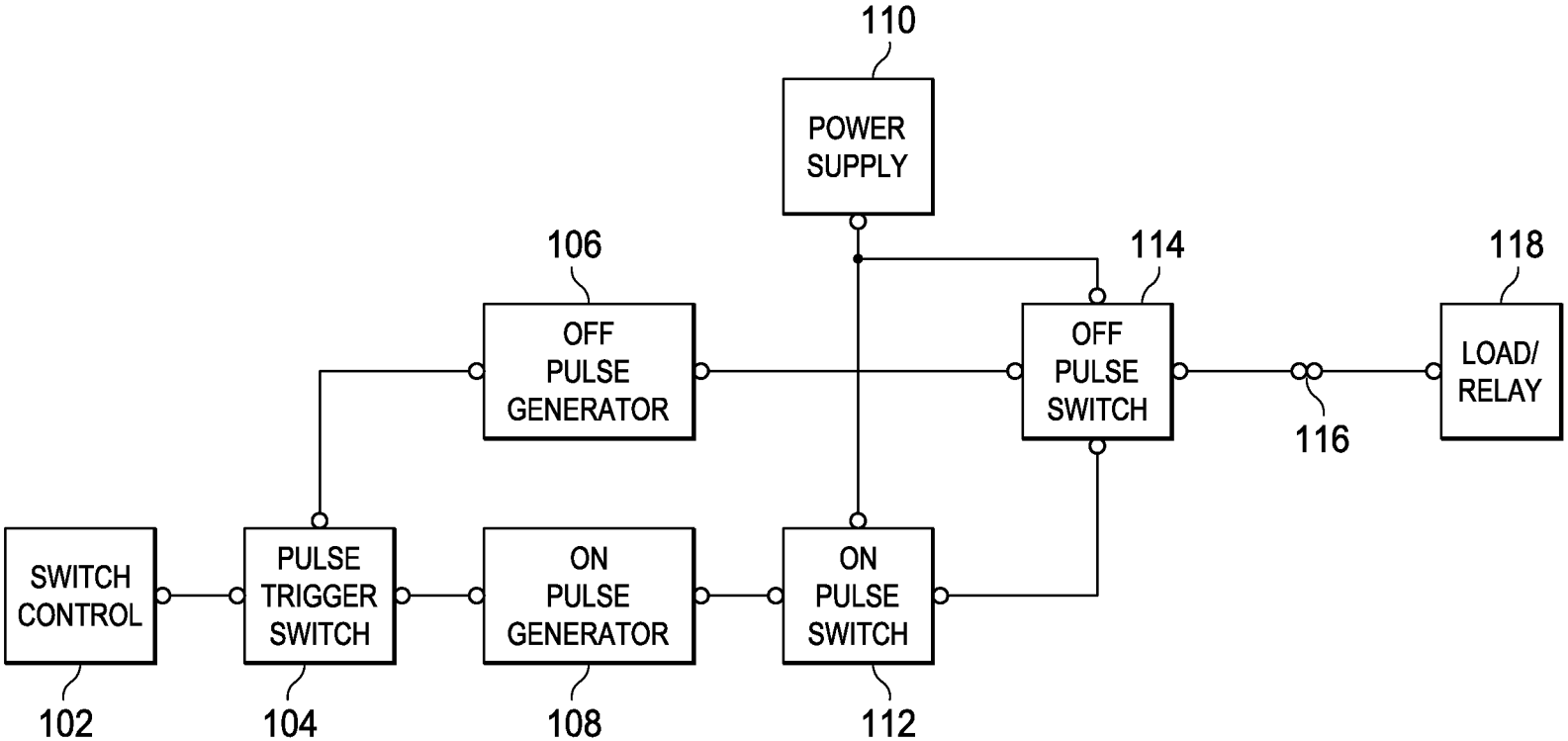
FIG. 1 is a logical diagram of a pulse solenoid control circuit according to an embodiment.

FIG. 1 illustrates a logical diagram of a pulse solenoid control circuit according to an embodiment. Output pulses are provides to an output 116 to control the activation or deactivation of an electrically controllable switch. The load 118 is activated, or turned on, with an output on pulse of a limited or predetermined duration. Additionally, the load 118 is deactivated, or turned off, with an output off pulse. In some embodiments, the output off pulse has a polarity that is the opposite of the polarity of the output on pulse. Additionally, the load 118 latches on or off, remaining activated or deactivated after the output on pulse or output off pulse terminates and until the state is reversed with another output on pulse or output off pulse. The load 118 at the output 116 is described as a load solenoid/relay, however it should be understood that a solenoid type relay, a solenoid, a relay or another electrically activated switch that can be used as a load 118.

An input signal Vin is received at a switch control module 102. The switch control module 102 controls a pulse trigger switch module 104, which in turn activates an on pulse generator module 108 or an off pulse generator module 106. The switch control module 102 generates a switch control signal to toggle the pulse trigger switch module 104 to provide a control signal to either the off pulse generator module 106 or the on pulse generator module 108. When the on pulse generator module 108 or the off pulse generator module 106 receives a control signal from the pulse trigger switch module 104, the respective pulse generator module 106 and 108 generates a pulsed signal of a predetermined duration, which is transmitted to a respective on pulse switch module 112 or an off pulse switch module 114. The pulse switch modules 112 and 114 are activated by the pulse signal from the pulse generator modules 106 and 108 and connect the power supply 110 to the load solenoid/relay 118 through the output 116. The on pulse switch module 112 and the off pulse switch module 114 connect the power supply 110 voltage or signal to the output 116 and load solenoid/relay 118 during the on or off pulse, respectively, resulting in a single output signal with a pulse at both the on and off time periods. In some embodiments, the pulse switch modules 112 and 114 provide pulses of opposite polarity to the output 116, but can also be arranged to provide pulses of a same polarity to the output 116.

Figure 2:
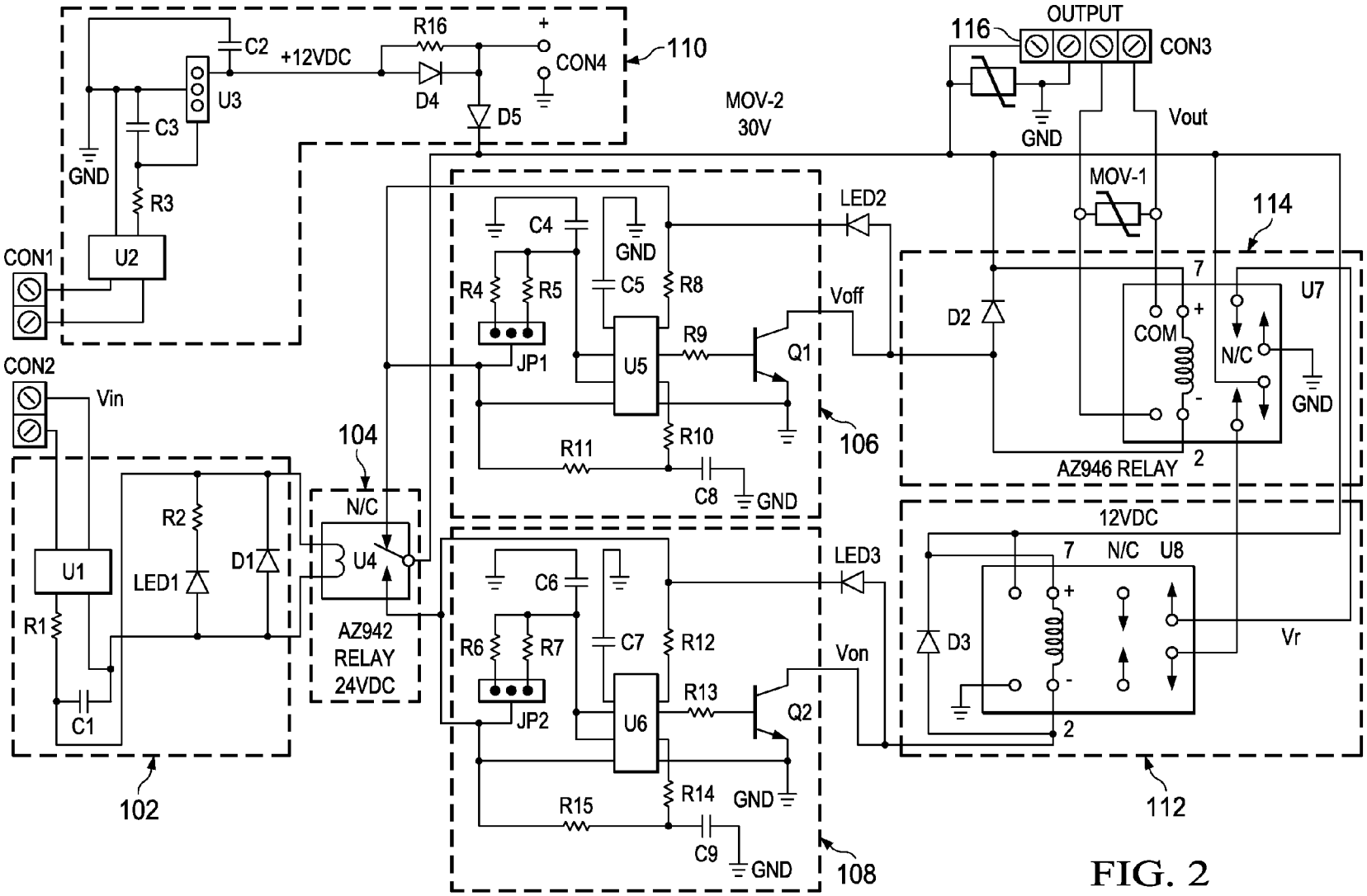
FIG. 2 is a circuit diagram illustrating an embodiment of a pulse solenoid control circuit.

FIG. 2 is a circuit diagram illustrating an embodiment of a pulse solenoid control circuit. In some embodiments, the input signal Vin is a 24 VAC input signal that is connected to the switch control module 102 at connector CON2. The printed circuit board "PCB" will accept a 24 VAC input signal Vin at the switch control module 102 and then pulse ON a double pole double throw relay U8, which in turn provides a momentary 12 VDC operating signal to the output 116 latch ON the solenoid of the load/relay 118. When the input signal Vin is withdrawn or turned off then an inverted momentary 12 VDC signal is provided for example, by a second double pole double throw relay U7, to the output 116 and unlatches or turns OFF the solenoid of the load/relay 118. In other embodiments, the switch control module 102 is configured to receive a DC signal, such as from a programmable logic controller, microprocessor, relay, battery, switch, circuit, or the like.

Providing, for example, a 12 VAC or 24VAC current to the power supply 110 at connector CON1 will provide the current to bridge rectifier U2 converting that current to VDC. Voltage regulator U3, resistor R3, capacitor C2, and capacitor C3 provide the power regulation for the 12 VDC needed to latch the solenoids. Resistor R16, diode D4 and diode D5 provide the needed voltage separation between current to permit a battery to be connected at connector CON4.

The battery provides 12 VDC and will charge from available current and provide a backup source of power to unlatch the solenoid(s) connected to output connector CON3 in the event of a power failure. Though not needed in all applications, this backup power source can in specific instances prove important.

The pulse trigger switch module 104 has a switch such as relay U4 that provides a first control signal in response to a first input signal value for Vin and a second control signal in response to a second input signal value for input signal Vin. The pulse trigger switch module 104 causes the on pulse generator module 108 to generate an on pulse signal in response to the input signal Vin being turned on, and causes the off pulse generator module 106 to generate an off pulse signal in response to the input signal Vin being turned off. For example, routing the input signal Vin through bridge rectifier U1 and additional circuitry including capacitor C1, resistors R1 and R2, LED LED1, and diode D1 provides a 12 VDC switch control signal to the pulse trigger switch module 104 that enables relay U4 of the pulse trigger switch module 104 to operate or switch to an ON state, transmitting the 12 VDC control signal to the on pulse generator module 108.

The on pulse generator module 108 generates an on pulse control signal in response to the on input signal, or where the input signal Vin has an on value. The on pulse control signal has a pulse duration of a predetermined period that is controlled by timer U6. In some embodiments the timer U6 is, for example, an NE555 timer that controls the pulse duration of the on pulse control signal. At timer U6, resistors R14 and R15 and capacitor C9 provide a ground signal that triggers the ON state of the timer U6 at pin 2. Once ON, the timer U6 output at pin 3 will go HIGH (+VDC). Resistor R13 and the base of transistor Q2 provided the ground signal to relay U8. LED LED3 indicates this process occurs. The ground signal will only occur for a period required for the voltage drop across pins 6 and 7 of the timer U6 to hit the threshold whereby a ground signal occurs from pin 7 to pin 6 (Discharge). Resistors R6 and R7 and Capacitor C6 provide this circuitry. Jumper post 2 allows a change between resistances of resistors R6 and R7 to modify the duration of the on pulse generated by the timer U6. The other pins on this timer U6 are pin 1 which is ground, pin 8 which is +VDC, pin 5 which is control and is connected to ground through capacitor C7, and pin 4 which is reset and that is connected to +VDC through resistor R12.

The on pulse switch module 112 is configured to connect a power signal from the power supply 110 to the output 116 in response to the on pulse control signal. In some embodiments, the relay U8 connects the power supply voltage to the output 116 during the on pulse control signal to provide an output on pulse to the output 116 to turn on or latch the load solenoid/relay 118. Since the ground on pulse control signal ground from the timer U6 is brief, contacts at relay U8 remain closed only briefly. However, the ground on pulse control signal from the timer U6 has the predetermined duration to provide adequate time for the load solenoid/relay 118 to switch an ON state. The duration of the on pulse control signal is independent from, and can longer or shorter than, the duration of the input signal Vin or than the duration of the input control signals from the pulse trigger switch module 104. This results in an output on pulse from relay U8 with a duration that permits switching on of the load relay 118 while conserving energy after the load relay 118 has been activated by terminating power to the relay when not needed for switching. The VDC and ground signals at input pins transmit through the normally open contacts to the normally closed contacts at relay U7. These signals are then conveyed through the input pins on this relay to output pins at connector CON3. Metal oxide varistor MOV1 provides current stability at the output to the latching solenoid by protecting the circuit against excessive transient voltages. Diode D3 provides flyback protection to the circuit at the relay U8 coil.

The off pulse generator module 106 generates an off pulse control signal in response to the off input signal, or where the input signal Vin has an off value. The off pulse control signal having a pulse duration of a predetermined period controlled by timer U5. The circuitry, functionality and components of off pulse generator module 106 are, in some embodiments, substantially the same as for on pulse generator module 108 and timer U6. In some embodiments the timer U5 is, for example, an NE555 timer, with timer U5 activated when the input signal Vin is switched off and timer U6 activated when the input signal Vin is switched on.

The off pulse switch module 112 is configured to connect a power signal from the power supply 110 to the output 116 in response to the off pulse control signal from the off pulse generator module. In some embodiments, the relay U7 connects the power supply voltage to the output 116 during the off pulse control signal to provide an output off pulse to the output 116 to turn off or unlatch the load relay 118. Once the 24 VAC input signal Vin is withdrawn at Connector CON2, relay U4 opens, thus diverting the 12 VDC switch control signal to the circuitry at timer U5.

Note that the normally open output pins at relay U7 are reversed from those of the normally closed pins of relay U7. This means that the ground derived from the output pin on U8 is opposite the ground at relay U7 and that the VDC is likewise opposite. Thus when the ground signal from Timer U5 energizes the relay U7, a current having an opposite polarity is transmitted to these same output pins at connector CON3. Additionally, since the output of relay U8 in the on pulse switch module 112 is connected to the normally closed pins of relay U7 in the off pulse switch module 114, the output of U8 is transmitted to connector CON3 when the relay U7 is not activated. Activation of relay U7 interrupts the signal from relay U8 and transmits the output off pulse. Thus, the off pulse switch module 114 passes on the signal from the on pulse switch module 112, but overrides the signal from the on pulse switch module 112, allowing the load relay 118 to be turned off during turn-on phase. In other embodiments, the on pulse switch module 112 is arranged to pass on and override the signal from the off pulse switch module 114.

Also shown on FIG. 2 are two additional output pins at connector CON3 along with varistor MOV2. This allows 12 VDC devices that do not require the latching ON or OFF to be connected to the 12 VDC power supply of the PCB. In essence, the first signal introduced is polarized to latch ON the solenoid coil, thus opening the valve attached to the solenoid. The second signal is of opposite polarity, latching OFF the coil and closing the valve.

In the embodiment disclosed in FIG. 2, relays U7 and U8 are shown as controlling the pulse of the power supply 110 voltage to generate output pulses at output 116. However, the relays U7 and U8 are not limited strictly to any particular type of relay or switch. Any electrically triggered switch or combination of switches may be used to generate the output pulses. For example, a transistor, solenoid, digital switch, switching circuit, contactor, dry contact, or other electrically controlled mechanical switch may be employed.

Figure 3:
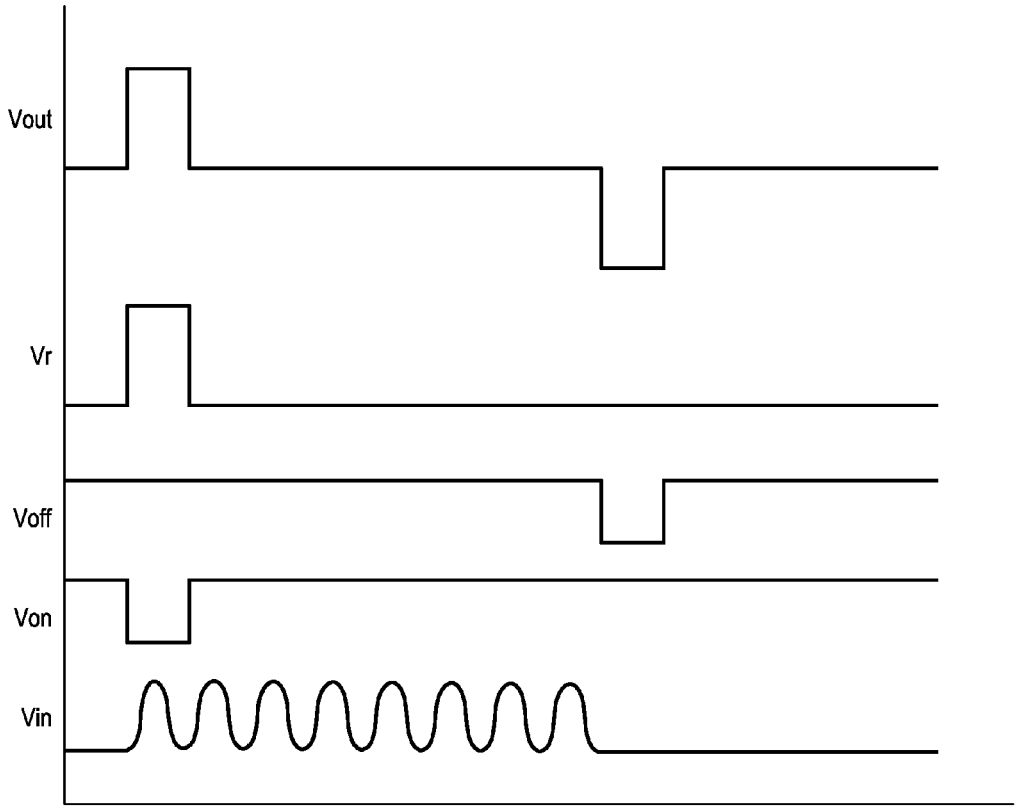
FIG. 3 is a diagram illustrating signals during operation of a pulse solenoid control circuit according to an embodiment.

FIG. 3 is a diagram illustrating signals during operation of a pulse solenoid control circuit according to an embodiment. The input signal Vin is switched from off to on, and the on pulse generator is activated. An on pulse is generated and the output Von of the on pulse generator causes the on pulse switch to connect the power supply voltage to the output Vout, resulting in a positive on pulse at Vout. The positive on pulse at Vout turns on or activates a load relay. When the input signal Vin is turned off, the transition from on to off causes the off pulse generator to generate an off pulse at the off pulse generator output Voff. The off pulse causes off pulse switch to connect the power supply voltage to the off pulse generator output Voff, resulting in an output off pulse that turns the load relay off. The Vout line of FIG. 3 illustrates the overall output signal, with the first output pulse having a first polarity and a timing and duration corresponding to the on pulse Von. The Vout line also has an off pulse with a negative polarity and a timing and duration corresponding to the off pulse Voff.

In an embodiment, where the off pulse is inverted, the output Voff has a negative off pulse. However, the embodiments disclosed herein are not limited to such an arrangement. Depending on the type of load relay or load relay configuration, a positive off pulse may be output. In such an arrangement the off pulse switch and the on pulse switch may be arranged in parallel instead of in series as shown in FIG. 2. Additionally, the pulses in Vout may have a different magnitude than the pulses generated by the pulse generators, since the pulse generators generate signals controlling the relays or other switches.

Thus, according to an embodiment, a device comprises a pulse trigger switch module configured to generate a first control signal in response to a first input signal value and generate the second control signal in response to a second input signal value. An on pulse generator module provides a first pulse signal having a first predetermined pulse duration in response to the first control signal and an off pulse generator module provides a second pulse signal having a second predetermined pulse duration in response to the second control signal. An on pulse switch module connects a power signal to an output in response to the first pulse signal and an off pulse switch module connects the power signal to the output in response to the second pulse signal. A switch control module is configured to receive an input signal having at least the first input signal value or the second input signal value. The switch control module is configured to generate a switch control signal based on the input signal, and the input switch control module is further configured to transmit the switch control signal to the pulse trigger switch module. The pulse trigger switch module comprises a first switch configured to generate the first control signal in response to an input signal being turned on and further configured generate the second control signal in response to the input signal being turned off. In some embodiments, the input signal is an alternating current (AC) signal and wherein the first control signal is a direct current (DC) signal. The on pulse generator comprises a first timer generating the first pulse signal with a first duration independent of a duration of the first control signal and the off pulse generator comprises a second timer generating the second pulse signal with a second duration independent of a duration of the second control signal. First circuitry is disposed at the first timer and is configured to adjust the first duration, and second circuitry is disposed at the second timer and is configured to adjust the second duration. An output of the on pulse switch module is connected through normally closed contacts at the off pulse switch module and the off pulse switch module is configured to override an output signal from the on pulse switch module when the off pulse switch module is activated. In some embodiments, the on pulse switch module provides a first output pulse having a first polarity where the first output pulse is provided to the output by connecting the power signal to the output for a predetermined period of time The off pulse switch module provides a second output pulse having a second polarity to the output where the second output pulse is provided by connecting the power signal to the output for a predetermined period of time. In such embodiments, the first polarity is different from the second polarity.

In other embodiments, a device comprises a first switch configured to provide a first control signal in response to a first input signal value and a second control signal in response to a second input value. A first timer is connected to the first switch and is configured to generate a first pulse signal in response to the first control signal and a second timer is connected to the first switch and is configured to generate a second pulse signal in response to the second control. A first relay is connected to the first timer and is configured to connect a power supply to an output during the first pulse signal and a second relay is connected to the second timer and configured to connect the power supply to the output during the second pulse signal. A switch control module is configured to receive an input signal and generate a switch control signal that causes the first switch to generate the first and second control signals based on a value of the input signal. In some embodiments, the input signal is an alternating current (AC) signal and the switch control signal is a direct current (DC) signal. The first timer generates the first pulse signal with a first duration independent of a duration of the first control signal and the second timer generates the second pulse signal with a second duration independent of a duration of the second control signal. In some embodiments, an output of the second relay is connected through normally closed contacts at the first relay and the first relay is configured to override an output pulse signal from the output of the second relay when the first relay is activated. The first relay provides a first output pulse to the output by connecting the power supply to the output for a predetermined period of time and the second relay provides a second output pulse to the output by connecting the power supply to the output in an reversed polarity arrangement for a predetermined period of time. A load is connected to the output, and the load is configured to latch on in response to the first output pulse and to latch on in response to the second output pulse.

A method of controlling an electrically latching load according to an embodiment comprises receiving a switch control signal at a pulse trigger switch module and providing, with the pulse trigger switch module, an on input signal to an on pulse generator module when the switch control signal is in an on state and providing, with the pulse trigger switch module, an off input signal to an off pulse generator module when the switch control signal is in an off state. An on pulse control signal is generated with the on pulse generator module in response to the on input signal, the on pulse control signal having a pulse duration of a predetermined period. An off pulse control signal is generated with the off pulse generator module in response to the off input signal, the off pulse control signal having a pulse duration of a predetermined period. An output on pulse is provided to an output with the on pulse switch module by connecting a first power supply signal to the output in response to the on pulse control signal and an output off pulse is provided to the output with the off pulse switch module by connecting a second power supply signal to the output in response to the off pulse control signal. The output on pulse has a polarity different than the output off pulse. In some embodiments, a load is activated with the output on pulse and the load is deactivated with the output off pulse. A duration of the output on pulse is different than a duration of the on input signal. Providing an output on pulse comprises providing the output on pulse to the output through the off pulse switch module.

While the disclosed embodiments have been described with reference to illustrative embodiments, this description is not intended to be construed in a limiting sense. Various modifications and combinations of the illustrative embodiments, as well as other embodiments of the presented principles, will be apparent to persons skilled in the art upon reference to the description. It is therefore intended that the appended claims encompass any such modifications or embodiments.

What is claimed is:

1. A device, comprising:

a pulse trigger switch module configured to generate a first control signal in response to a first input signal value and generate a second control signal in response to a second input signal value;

an on pulse generator module configured to provide a first pulse signal having a first predetermined pulse duration in response to the first control signal;

an off pulse generator module configured to provide a second pulse signal having a second predetermined pulse duration in response to the second control signal;

an on pulse switch module configured to connect a power signal to an output in response to the first pulse signal; and an off pulse switch module configured to connect the power signal to the output in response to the second pulse signal, wherein the off pulse switch module is further configured to override an output signal from the on pulse switch module when the off pulse switch module is activated.

2. The device of claim 1, further comprising a switch control module configured to receive an input signal having at least the first input signal value or the second input signal value, the switch control module configured to generate a switch control signal based on the input signal, the switch control module further configured to transmit the switch control signal to the pulse trigger switch module.

3. The device of claim 2, wherein the pulse trigger switch module comprises a first switch configured to generate the first control signal in response to the input signal being turned on and further configured generate the second control signal in response to the input signal being turned off.

4. The device of claim 3, wherein the input signal is an alternating current (AC) signal; and wherein the first control signal is a direct current (DC) signal.

5. The device of claim 2, wherein the on pulse generator module comprises a first timer generating the first pulse signal, wherein the first predetermined pulse duration is independent of a duration of the first control signal; and wherein the off pulse generator module comprises a second timer generating the second pulse signal, wherein the second predetermined pulse duration is independent of a duration of the second control signal.

6. The device of claim 5, further comprising:

first circuitry disposed at the first timer and configured to adjust the first predetermined pulse duration; and second circuitry disposed at the second timer and configured to adjust the second predetermined pulse duration.

7. The device of claim 1, wherein an output of the on pulse switch module is connected through normally closed contacts at the off pulse switch module.

8. The device of claim 1, wherein the on pulse switch module provides a first output pulse having a first polarity;

wherein the first output pulse is provided to the output by connecting the power signal to the output for a first predetermined period of time;

wherein the off pulse switch module provides a second output pulse having a second polarity to the output;

wherein the second output pulse is provided by connecting the power signal to the output for a second predetermined period of time; and wherein the first polarity is different from the second polarity.

9. A device, comprising:

a first switch configured to provide a first control signal in response to a first input signal value and provide a second control signal in response to a second input value;

a first timer connected to the first switch and configured to generate a first pulse signal in response to the first control signal;

a second timer connected to the first switch and configured to generate a second pulse signal in response to the second control signal;

a first relay connected to the first timer, the first relay configured to connect a power supply to an output during the first pulse signal, wherein the first relay provides a first output pulse to the output by connecting the power supply to the output for a predetermined period of time; and a second relay connected to the second timer, the second relay configured to connect the power supply to the output during the second pulse signal, wherein the second relay provides a second output pulse to the output by connecting the power supply to the output in a reversal polarity arrangement for a second predetermined period of time.

10. The device of claim 9, further comprising:

a switch control module configured to receive an input signal and generate a switch control signal that causes the first switch to provide the first and second control signals based on a value of the input signal.

11. The device of claim 10, wherein the input signal is an alternating current (AC) signal; and wherein the switch control signal is a direct current (DC) signal.

12. The device of claim 9, wherein the first timer generates the first pulse signal with a first duration independent of a duration of the first control signal; and wherein the second timer generates the second pulse signal with a second duration independent of a duration of the second control signal.

13. The device of claim 9, further comprising a load connected to the output, the load configured to latch on in response to the first output pulse and further configured to latch on in response to the second output pulse.

14. The device of claim 9, wherein an output of the second relay is connected through normally closed contacts at the first relay; and wherein the first relay is configured to override an output pulse signal from the output of the second relay when the first relay is activated.

15. A method of controlling an electrically latching load, comprising:

receiving a switch control signal at a pulse trigger switch module;

providing, with the pulse trigger switch module, an on input signal to an on pulse generator module when the switch control signal is in an on state;

providing, with the pulse trigger switch module, an off input signal to an off pulse generator module when the switch control signal is in an off state;

generating an on pulse control signal with the on pulse generator module in response to the on input signal, the on pulse control signal having a first pulse duration of a first predetermined period;

generating an off pulse control signal with the off pulse generator module in response to the off input signal, the off pulse control signal having a second pulse duration of a second predetermined period;

providing an output on pulse to an output with an on pulse switch module by connecting a first power supply signal to the output in response to the on pulse control signal; and providing an output off pulse to the output with an off pulse switch module by connecting a second power supply signal to the output in response to the off pulse control signal, wherein the off pulse switch module is configured to override the output on pulse when the off pulse switch module is activated.

16. The method of claim 15, wherein the output on pulse has a polarity different than the output off pulse.

17. The method of claim 16, further comprising:

activating a load with the output on pulse; and deactivating the load with the output off pulse.

18. The method of claim 15, wherein a duration of the output on pulse is different than a duration of the on input signal.

19. The method of claim 15, wherein the providing an output on pulse comprises providing the output on pulse to the output through the off pulse switch module.

20. The method of claim 15, wherein the duration of the on pulse control signal is independent of the duration of the off pulse control signal.

* * * * *